US010195756B2

(12) United States Patent
Pardini

(10) Patent No.: US 10,195,756 B2
(45) Date of Patent: Feb. 5, 2019

(54) DEVICE TO CLAMP LOGS DURING THE CUT THEREOF AND SAWING MACHINE COMPRISING SAID DEVICE

(71) Applicant: UNIVERSAL TISSUE TECHNOLOGY S.R.L., Lucca (IT)

(72) Inventor: Gionata Pardini, Viareggio (IT)

(73) Assignee: MTORRES TISSUE S.R.L. (IT)

( * ) Notice: Subject to any disclaimer, the term of this patent is extended or adjusted under 35 U.S.C. 154(b) by 5 days.

(21) Appl. No.: 15/544,542

(22) PCT Filed: Dec. 18, 2015

(86) PCT No.: PCT/EP2015/080567
§ 371 (c)(1),
(2) Date: Jul. 19, 2017

(87) PCT Pub. No.: WO2016/124297
PCT Pub. Date: Aug. 11, 2016

(65) Prior Publication Data

US 2017/0361484 A1 Dec. 21, 2017

(30) Foreign Application Priority Data

Feb. 3, 2015 (IT) ..... BO2015A0042

(51) Int. Cl.
*B26D 7/02* (2006.01)
*B25H 1/08* (2006.01)
(Continued)

(52) U.S. Cl.
CPC ..... *B26D 7/02* (2013.01); *B25H 1/08* (2013.01); *B26D 3/16* (2013.01); *B26D 7/0633* (2013.01); *B26D 7/0683* (2013.01); *B27B 27/02* (2013.01); *B27B 31/006* (2013.01); *B27B 33/02* (2013.01); *B26D 2210/11* (2013.01)

(58) Field of Classification Search
CPC .... B26D 7/02; B26D 7/0633; B26D 2210/11; B26D 3/16
See application file for complete search history.

(56) References Cited

U.S. PATENT DOCUMENTS 5,357,833 A * 10/1994 Biagiotti ..... B26D 7/02 269/130
5,509,336 A * 4/1996 Biagiotti ..... B23B 31/1269 279/109

(Continued)

FOREIGN PATENT DOCUMENTS

EP 1582320 A1 10/2005
EP 2489486 A1 8/2012
EP 2623279 A1 8/2013

OTHER PUBLICATIONS

International Search Report and Written Opinion of the International Searching Authority Application No. PCT/EP2015/080567 completed: Mar. 22, 2016; dated Apr. 1, 2016 10 pages.

*Primary Examiner* — Sean Michalski
(74) *Attorney, Agent, or Firm* — Ware, Fressola, Maguire & Barber LLP

(57) ABSTRACT

The device comprises a log advancing path and a set of jaws in the form of double four-bar linkage, with an adjusting mechanism to adjust the position of the jaws according to the diameter of the logs to be cut.

18 Claims, 8 Drawing Sheets

(51) Int. Cl.

| | |
|---|---|
| ***B26D 7/06*** | (2006.01) |
| ***B27B 27/02*** | (2006.01) |
| ***B27B 31/00*** | (2006.01) |
| ***B27B 33/02*** | (2006.01) |
| ***B26D 3/16*** | (2006.01) |

(56) References Cited

U.S. PATENT DOCUMENTS

| | | | | |
|---|---|---|---|---|
| 5,647,259 | A * | 7/1997 | Biagiotti | B26D 3/16 269/132 |
| 6,532,851 | B2 * | 3/2003 | Moss | B26D 7/02 83/457 |
| 7,617,852 | B2 * | 11/2009 | Perini | B26D 7/02 144/1.1 |
| 2009/0314147 | A1 * | 12/2009 | Catelli | B26D 1/46 83/174 |
| 2012/0204691 | A1 * | 8/2012 | Gambini | B26D 7/02 83/84 |
| 2012/0297944 | A1 * | 11/2012 | Maddaleni | B26D 3/16 83/23 |
| 2013/0139664 | A1 * | 6/2013 | Diehr | B26D 3/16 83/37 |
| 2015/0102545 | A1 * | 4/2015 | Barsotti Giovanni | B26D 3/16 269/164 |
| 2016/0368158 | A1 * | 12/2016 | Hsu | B26D 7/02 |
| 2018/0162005 | A1 * | 6/2018 | Kettula | B26D 7/04 |

* cited by examiner

DEVICE TO CLAMP LOGS DURING THE CUT THEREOF AND SAWING MACHINE COMPRISING SAID DEVICE

BACKGROUND OF THE INVENTION

The present invention relates to devices and machines to process wound web material to form rolls. The invention especially relates to devices and machines to cut rolls made of paper, in particular tissue paper or similar cellulose products.

In the field of converting continuous web material, like paper or other cellulose-based materials, it is usually known to wind a web of indefinite length to form logs of high axial length, that are then cut into rolls of smaller axial length, destined to be packaged and distributed to end users. Examples of this kind of products are in the field of tissue paper, for instance rolls of toilet paper, kitchen towels and the like.

More specifically, rewinding machines produce logs of axial length equal to the length of the parent reel, from which the web material is unwound. The logs are then cut by means of saw machines, dividing each log into a plurality of rolls of smaller axial dimension equal to the dimension of the finished product.

The saw machines comprise one or more cutting blades, typically rotating disc blades or band blades. The blades act cyclically on one or more logs moving forward in advancing channels that are arranged adjacent to one another. At every cycle, the blade cuts one or more logs according to a cutting plane orthogonal to the axis of the logs. During cutting, the logs shall be held against the thrust of the blade, in a direction orthogonal to the axis of the log and thus to the feeding direction of the log in the advancing channel. To this end, clamp devices have been developed to clamp the logs laterally. U.S. Pat. No. 6,532,851, and other prior art documents cited therein, disclose an exemplary saw machine of the type described above.

The clamp devices to clap the logs laterally during cutting shall easily adapt to the diameter of the logs. To this end, various mechanisms have been developed to adapt the log clamp device. However, there is still a need to improve these devices, as regards both easiness of use and adjustment effectiveness and speed.

SUMMARY OF THE INVENTION

According to one aspect, a device is provided to clamp a log to be cut, comprising a log advancing path and, on each side of an intermediate plane parallel to the advancing path, a set of jaws. Each set of jaws comprises a first jaw and a second jaw, the first jaw being hinged to a fixed structure around a first pivoting axis and the second jaw being hinged to the fixed structure around a second pivoting axis. The first jaw and the second jaw of each set are joined together by means of a connecting rod, which is hinged, at opposite ends, to the first jaw and to the second jaw. The two jaws form, together with the connecting rod and the fixed structure, a four-bar linkage. The first jaw and the second jaw form a respective first rocker and a respective second rocker of the four-bar linkage. The first rocker may extend beyond the pivoting axis of the connecting rod and at the opposite side with respect to the pivoting axis, around which the rocker articulates with the fixed structure, thus forming an arm. This arm is, in turn, hinged to a first end of a respective rod-strut. The rod-strut is movable in order to make the respective four-bar linkage oscillate and to adjust the position of the jaws according to the diameter of the log to be cut.

According to embodiments described herein, a retaining device is provided to clamp a log of web material, comprising a log advancing path, wherein a set of jaws is arranged on each side of an intermediate plane preferably approximately vertical and parallel to the advancing path. Each set of jaws may comprise at least a first jaw and a second jaw. The first jaw and the second jaw may be hinged to a fixed structure with respect to the advancing path and may be fastened to a first end of a rod-strut. A second end of the rod-strut is hinged to an adjusting member, movable with respect to the fixed structure, to adjust the position of the jaws with respect to each other and with respect to the fixed structure.

The intermediate plane may substantially be a symmetry plane of the jaws.

In some embodiments, the movable member may move according to a direction orthogonal to the advancing path, allowing the adjustment of the reciprocal position of the two jaws with respect to each other and to the fixed structure of the device.

Practically, the movement of the movable member causes, by means of the respective rods-struts, a symmetrical adjustment of the first jaws and second jaws of each set of jaws, so as to adjust the position of the jaws to the log diameter.

In practical embodiments, the first jaw and the second jaw on each side of the intermediate plane are hinged to the fixed structure according to a first pivoting axis and a second pivoting axis, spaced from each other and substantially parallel.

In some embodiments, an actuator may be provided to open and close the jaws, in order to allow the log to be cyclically held and released, synchronously with the cutting movement of a cutting blade for log cutting.

In some embodiments, the opening and closing actuator may be the same actuator controlling the movement of the movable member, so that essentially one single actuator, or more actuators working synchronously and in parallel, may be controlled in order both to adjust the position of the jaws according to the diameter of the logs, and to control the opening and closing movement of the jaws, synchronized with the intermittent forward movement of the logs through the saw machine.

Preferably, the function of opening-closing the jaws may be separated from the function of adjusting the jaw position according to the log diameter. In this case, the movable member to adjust the position of the jaws with respect to each other and with respect to the fixed structure may be controlled by a first actuator, while the opening-closing movement of the jaws, synchronized with the log advancing movement and with the movement of the cutting blade, may be controlled by one or more different actuators.

This solution, wherein the two functions are performed by different mechanisms, is actually the preferred one, as it allows using optimized technical solutions according to the different needs of the two movements. Namely, the jaws adjusting movement requires a relatively wide movement, i.e. a wide rotation of the jaws, in order to adapt to even greatly variable diameters of the logs. Moreover, this movement shall be controlled relatively accurately. It is necessary that the operator can set the right position of the jaws with respect to the fixed structure and with respect to each other, in order to adapt to the diameter of the logs to be cut. The adjusting mechanism may even be manual, for instance by means of a hand wheel controlling a threaded bar or a bar with pinions engaging racks fastened to the jaws. A graded scale could help in identifying and selecting the right position.

The adjusting movement is preferably provided by means of a servo-controlled mechanism. The adjusting movement may be provided, for example, by means of a linear or rotating electric motor. An electronic control allows to know and to change, in a controlled manner, the position of the jaws through the movement of the motor.

In other embodiments, the servo-controlled mechanism may comprise one or more cylinder-piston actuators, preferably hydraulic because of their greater accuracy. An encoder or other position detecting and recording system may be combined with the cylinder-piston actuator or actuators.

In order to control opening and closing of the jaws synchronously with the advancing movement of the logs and with the movement of the cutting blade, it is possible to provide an actuating system shared among several clamp devices, or an actuator for each clamp system, as it will be better explained below with reference to some embodiments.

For example, in some embodiments one of the rods-struts may have variable length. The rod-strut of variable length may be constituted, for example, by a linear actuator, or it may comprise a linear actuator, the length whereof can be changed synchronously with the movement of the logs and of the cutting blade. In other embodiments, both the rods-struts may have variable length, so that the jaws open and close symmetrically.

In other embodiments, the rods-struts may have fixed length; they may be, for instance, fixed elements, and may be hinged to a movable element, whose motion controls the opening and closing pivoting movement of the jaws by means of the motion transmitted through the rods-struts.

In some embodiments, the opening and closing movement of the jaws can be dispensed with. In this case, when the logs are cut into rolls, the jaws remain in a fixed position, so as to clamp the log and the cut rolls, without however preventing the forward movement between two subsequent cuts. This may be useful, for example, when the forward movement of the logs to be cut is continuous.

In some embodiments, each first jaw is rigidly connected to an arm, which is hinged to the respective rod-strut. Each second jaw may be connected to said arm by means of a respective connecting rod. The connecting rod may be hinged to the arm in an intermediate position between the point where the first jaw is hinged to the fixed structure and the point where the arm is hinged to the respective rod-strut.

According to embodiments described herein, a device is provided to clamp a log to be cut, comprising a log advancing path and, on each side of an intermediate plane, preferably vertical and parallel to the advancing path, a set of jaws, each set comprising a first jaw and a second jaw, hinged to a fixed structure around a respective first pivoting axis and second pivoting axis; wherein each first jaw and second jaw are joined together by means of a connecting rod and form, with the connecting rod and the fixed structure, a four-bar linkage. The first jaw and the second jaw may form a respective first rocker and second rocker of the four-bar linkage. In some embodiments, the first rocker may extend so as to form an arm, which is, in turn, hinged to a first end of a respective rod-strut. Each rod-strut may be hinged, at a respective second end thereof, to a cursor movable along the fixed structure orthogonally to the advancing path, the cursor movement causing the symmetrical oscillation of said four-bar linkages.

The clamp device to clamp a log to be cut, configured as described herein, can quickly and easily adapt to the log diameter, without the need for complex changes, only through the (manual or servo-controlled) displacement of the cursor or slide, to which the rods-struts controlling the jaw pivoting movement are fastened. Practically, by sliding the cursor upwards or downwards through the rods-struts of each log clamp device, the sets of jaws are displaced substantially symmetrically and take a right angular position according to the diameter of the logs to be processed.

According to a further aspect, a saw machine is described herein to cut logs of wound web material, comprising: a cutting blade configured and controlled to cut the logs according to a cutting plane orthogonal to the log axis; at least a log advancing path with log feeding members whose movement is synchronized with the movement of the blade; and, along said at least one log advancing path, at least a first clamp device to clamp the logs to be cut, as defined above, arranged adjacent to the cutting plane of the blade.

In some embodiments, for said at least one log advancing path, also a second device is provided to clamp the logs to be cut as defined above. Advantageously, the first and the second device to clamp the logs are arranged on opposite sides of the cutting plane. A slot may be defined therebetween, through which the cutting blade passes, i.e. a slot in correspondence of the cutting plane.

BRIEF DESCRIPTION OF THE DRAWINGS

Various features and aspects of the invention will be described below with reference to the attached drawings, showing non-limiting embodiments of a log clamp device to clamp logs during the cut thereof. More in particular, in the drawings where the same numbers indicate the same parts.

DETAILED DESCRIPTION OF EMBODIMENTS OF THE INVENTION

Figure 1:
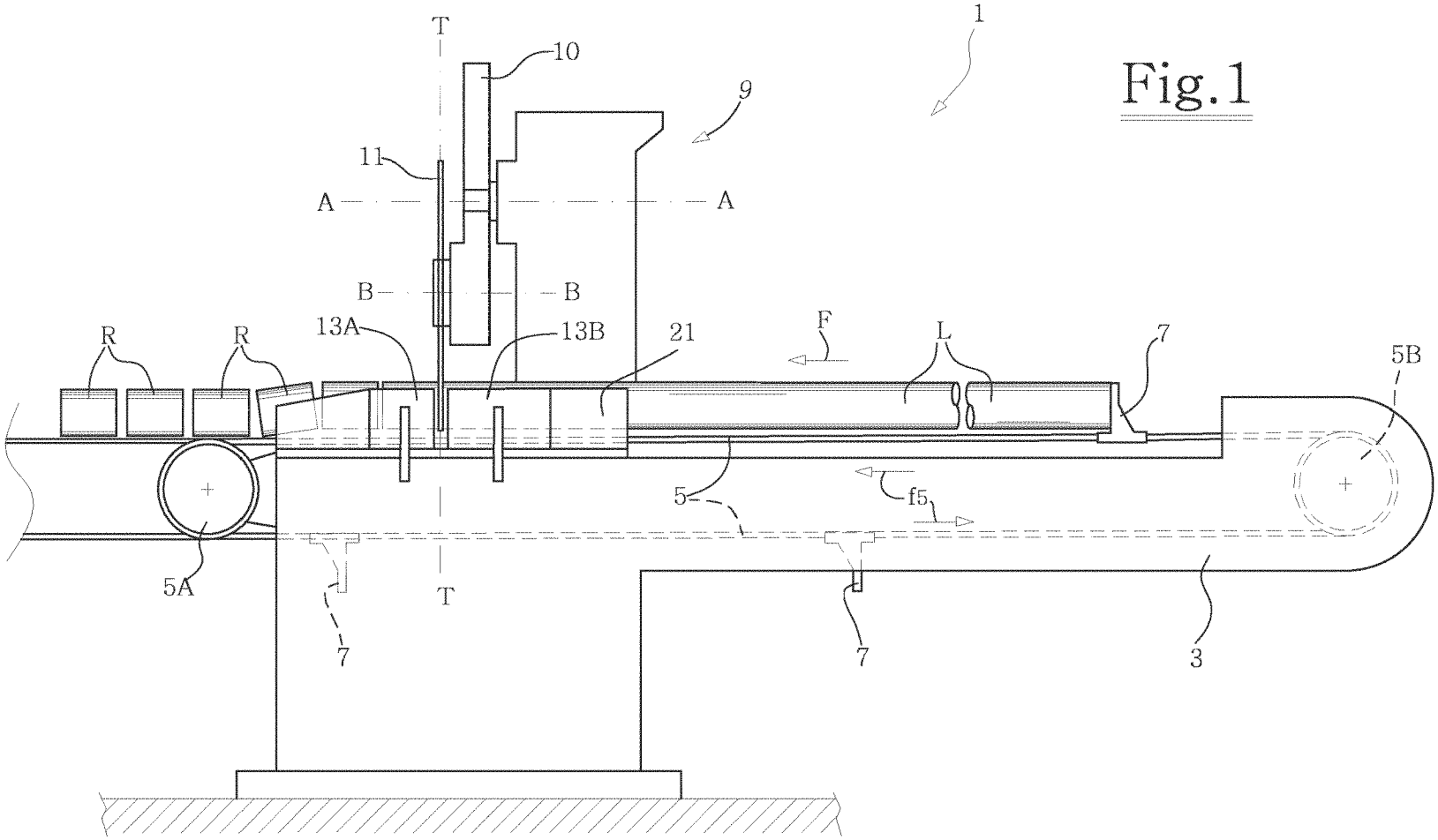
FIG. 1 is a schematic side view of a saw machine.
Figure 2:
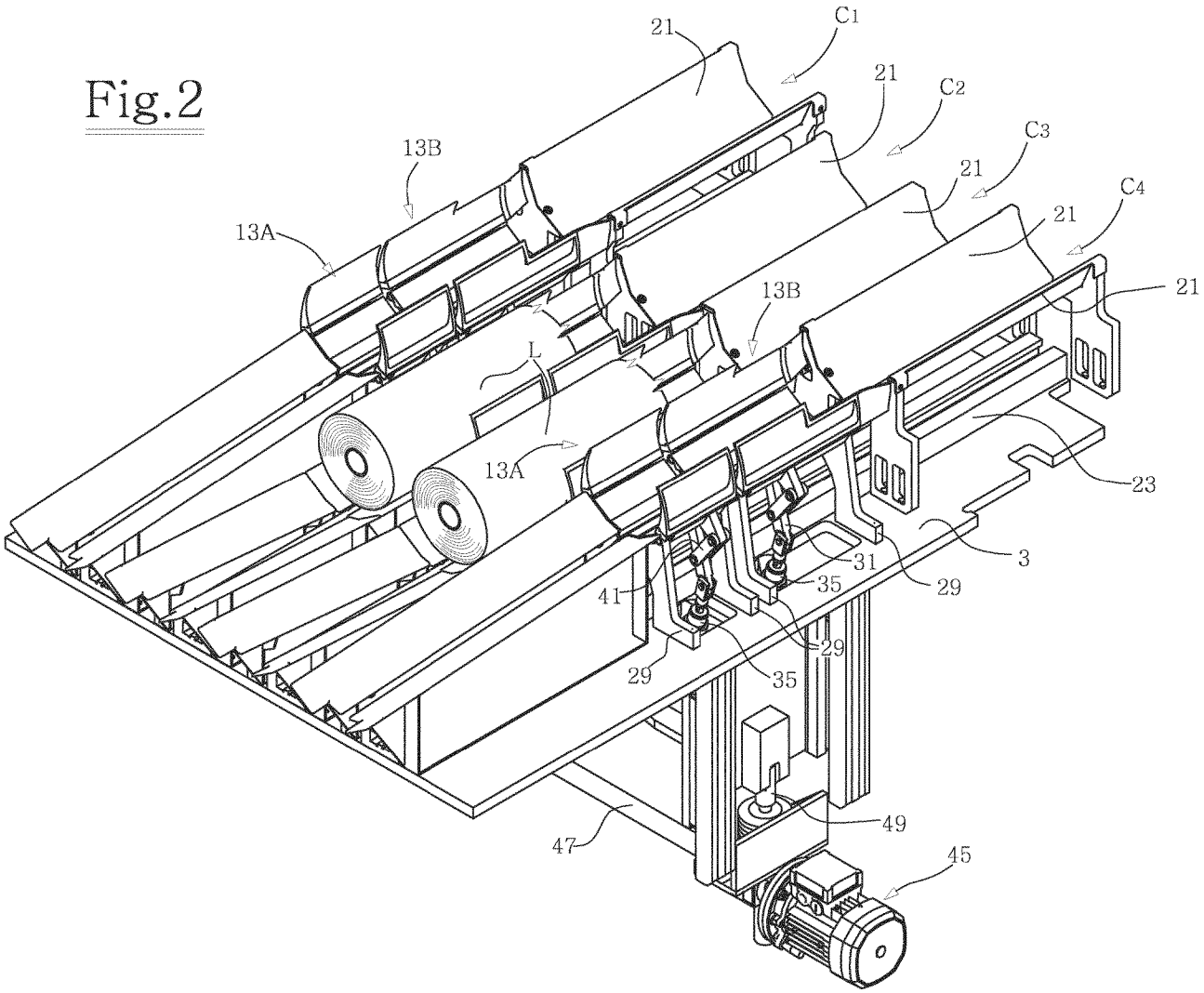
FIG. 2 is a simplified axonometric view of a plurality of log clamp devices in a saw machine with a plurality of log advancing channels arranged in parallel.

FIG. 1 schematically illustrates a saw machine 1 to cut logs L of great axial dimension into single rolls R destined to be packaged and distributed. The saw machine 1 may comprise a stationary bearing structure 3, onto which one or more conveyors 5 are mounted.

Each conveyor 5 may comprise a continuous flexible member, for example a chain or belt. Each continuous flexible member may be driven around pulleys 5A and 5B, at least one of which is motorized so as to move with the respective conveyor according to arrow f5. The conveyors 5 are provided with pushers 7, which move forward the logs L, to be cut into rolls R, along the respective advancing channel. A cutting head 9 is arranged along the log advancing path.

The cutting head 9 may comprise one or more cutting blades. The cutting blade may be a band blade. In other embodiments, the cutting blade may be a disc blade. The cutting blade may move according to a continuous cyclical movement, for instance along a circular trajectory. In other embodiments, the cutting blade may move with a reciprocating motion.

In the illustrated embodiment, the cutting head 9 comprises a rotating plate 10, driven into rotation around a rotation axis A-A by means of a motor, not shown. On the plate 10, a disc cutting blade 11 may be mounted, rotating around an axis B-B. In some embodiments, more cutting blades 11 may be mounted on the plate 10, to perform more cuts per time unit. T-T indicates the track of the cutting plane, which is usually orthogonal to the advancing direction F of the logs L through the saw machine 1.

In the cutting area, upstream of, and downstream of the cutting plane T-T, devices 13A, 13B are provided to clamp the logs L against the thrust exerted by the cutting blade 11 acting on the log; said thrust being exerted orthogonally to the log axis and therefore orthogonally to the log advancing direction F through the saw machine 1.

In the illustrated embodiment, the saw machine 1 is associated with four advancing channels, parallel to one another, along which the logs L move forwards. In FIGS. 2 to 5, the four channels are indicated with C1, C2, C3 and C4. Generally, along each channel C1-C4 two devices are arranged to clamp the logs during cutting, one upstream of, and the other one downstream of, the cutting plane T-T. The clamp devices to clamp the logs during cutting are substantially equal for each channel C1-C4. Moreover, from a functional and structural viewpoint, each device 13A, downstream of the cutting plane T-T with respect to the advancing direction F of the logs L, is substantially equivalent to the corresponding device 13B arranged upstream of said cutting plane T-T.

A pair of devices 13A, 13B of a generic channel C1-C4 will be described below, being understood that the remaining devices have substantially the same structure. Moreover, only one of the devices 13A, 13B will be described in detail below, as the other is equivalent.

Upstream of the devices 13A, 13B, along each channel C1-C4, cradles 21 may be provided, along which the logs L slide, pushed by the pushers 7 of the conveyors 5. The cradles 21 may be formed by curved metal sheets, each of which defines a portion of ruled surface, for example a cylindrical surface. Each cradle is longitudinally interrupted in the lower part, in order to allow the passage of the pushers 7, which are connected to the respective conveyor 5 associated with each channel C1-C4. In practical embodiments, this interruption may be defined by two curved metal sheets adjacent to each other, whose opposite edges define a groove or slot for the passage of the pushers 7.

Figure 3:
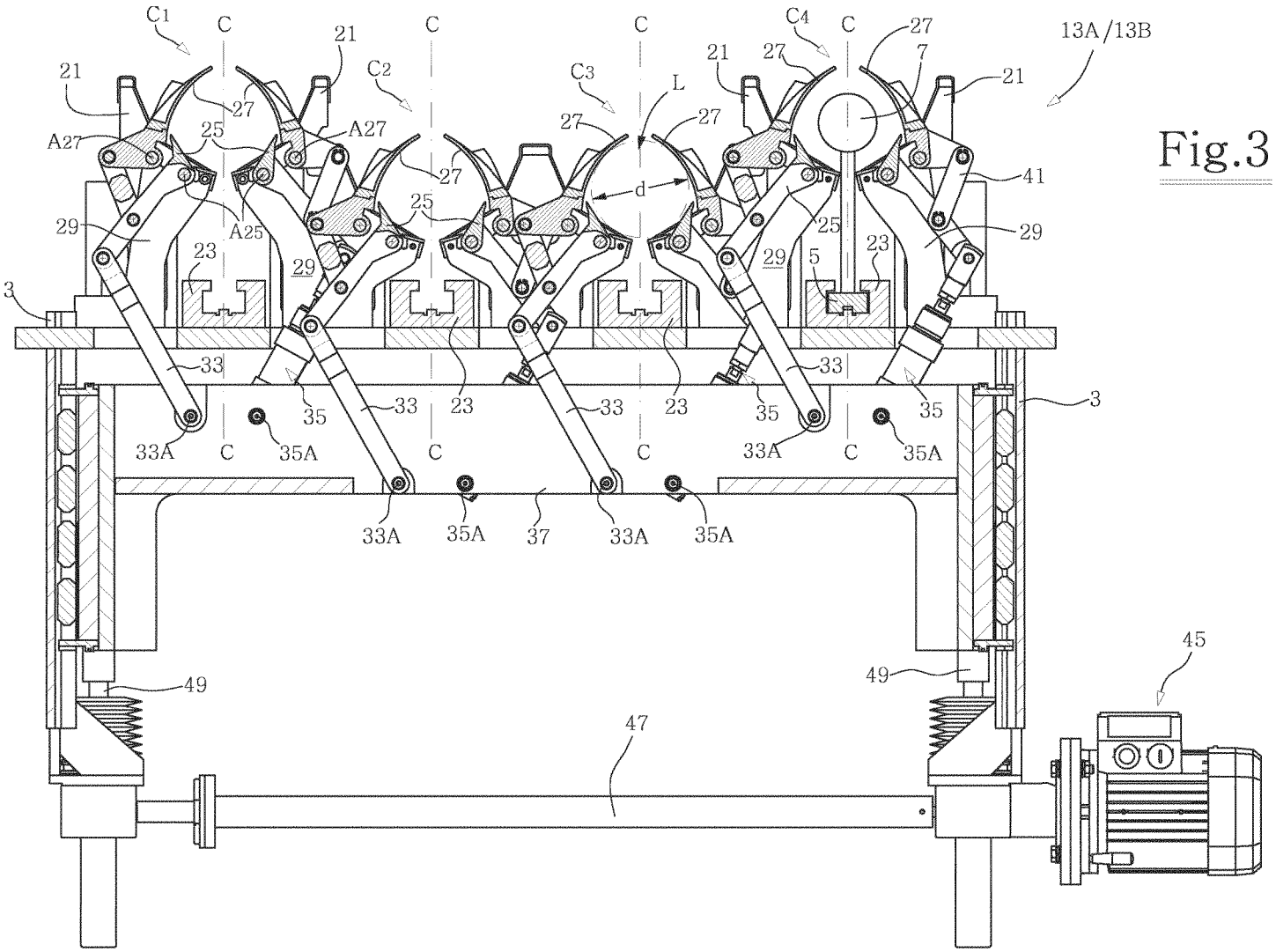
FIGS. 3 and 4 are cross-sections according to a transverse plane, i.e. a plane orthogonal to the log advancing direction, wherein the log clamp devices are shown in two different positions, to process logs of different diameters.
Figure 4:
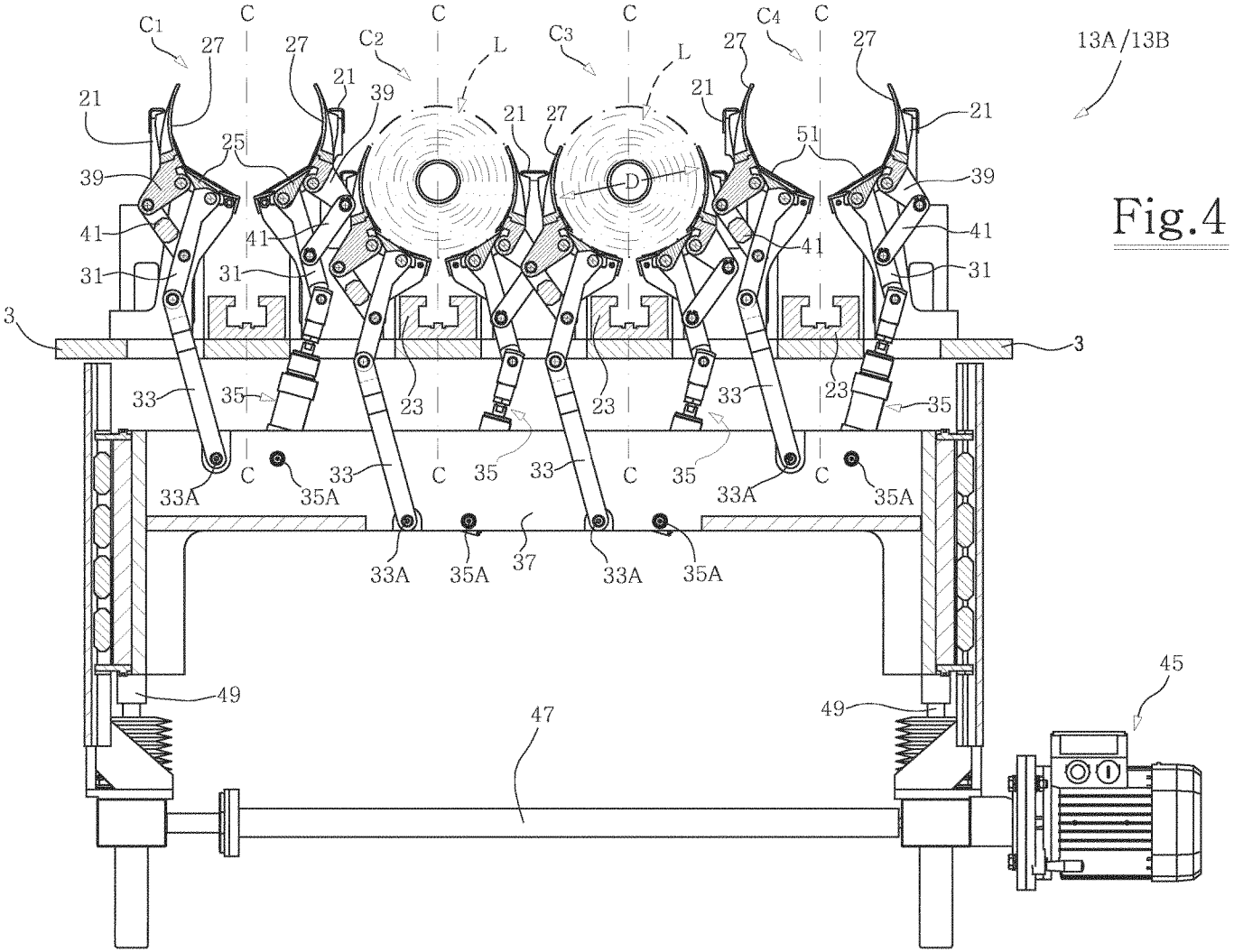

In some embodiments, the conveyors 5, and more specifically the continuous flexible members thereof, driven around the pulleys 5A, 5B, may be guided in corresponding guides 23, see in particular FIGS. 3 and 4. In particular, FIG. 3 shows, by way of example, for the channel C4, a pusher 7 and the respective conveyor 5, while these elements have been omitted in the remaining channels and figures for the sake of clarity of representation.

In some embodiments, each device 13A, 13B comprises a set of jaws to clamp the logs L to be cut. The set of jaws is substantially symmetrical with respect to an intermediate vertical plane containing the axis of the logs. The symmetry plane is indicated with C-C, for instance in FIG. 3. On each side of the symmetry plane C-C, the set of jaws comprises a first jaw 25, or lower jaw, and a second jaw 27, or upper jaw. The first jaw 25 may be hinged around a pivoting axis A25 to an upright 29 or other component integral with the stationary structure 3 of the saw machine 1. For example, two uprights 29, symmetrical with respect to the plane C-C, may be associated with each feeding channel C1-C4. Each one of the above mentioned first jaws 25 is hinged around a respective pivoting axis A25 to each of the two uprights 29.

The second jaws 27 may be hinged around respective pivoting axes A27 to the same uprights 29 or other components integral with the stationary structure 3 of the saw machine 1.

Advantageously, the pivoting axes A25 and A27 are substantially parallel to each other and to the axis of the logs L moving forward according to the advancing direction F along the log advancing path in the respective channel C1-C4.

In some embodiments, each of said first jaws 25 is rigidly connected to an arm 31 rotating around the same pivoting axis A25 around which the respective first jaw 25 is hinged to the upright 29. The arm 31 may extend from one own end, or proximal end, i.e. adjacent to the respective first jaw 25, up to a second end, or distal end 31A. Each arm 31 may be hinged at the second end 31A, in 31B, to a respective rod-strut. Herein and in the attached claims, rod-strut means an element or mechanical member of elongated shape and substantially rigid, suitable to transmit a traction or thrust force between two elements to which the mechanical member is hinged. In the attached figures, one of the rod-strut is indicated with 33, and the other one with 35.

The rods-struts 33, 35 may be different from each other as regards structure and function. In fact, in the illustrated embodiment the rod-strut 33 is substantially constituted by a rigid element, for instance a connecting rod. The rod-strut 33 may be hinged to a movable member in 33A. In the embodiment of FIGS. 1-5, the movable member is constituted by a cursor or slide 37, provided with vertical movement according to the double arrow f37, for the purposes described below.

Also the second rod-strut 35 may be hinged in 35A to the same cursor 37 or to another cursor movable integrally or synchronously with the cursor 37, to which the rod-strut 33 is hinged in 33A. In the illustrated embodiment, the cursor 37 is unique for both the rods-struts 33, 35 of each device 13A, 13B.

While the rod-strut 33 has a fixed length, the rod-strut 35 may have a variable length, i.e. the distance between the hinges 31B, 35A may be variable. To this end, in some embodiments the rod-strut 35 incorporates, or is constituted by, a hydraulic or pneumatic cylinder-piston actuator. In other embodiments, the rod-strut 35 may be a mechanical jack or other member suitable to lengthen and shorten for the purposes explained below.

In other embodiments, not shown, the length of both the rods-struts 33, 35 may be varied by using a linear actuator or other suitable mechanism. In further embodiments, the two rods-struts 33, 35 may have fixed length and may be both constituted like the rod-strut 33.

In the illustrated embodiment, each jaw 27 is integral with a small arm 39, whose length may be lower than that of the arm 31. The length of the small arm 39 may be, for example, ⅓ of the length of the arm 31. Each small arm 39, integral with the respective second jaw 27, may be hinged to a connecting rod 41 in 39A. Each connecting rod 41 is hinged, at the end opposite with respect to the hinge axis 39A, with the corresponding arm 31. The hinge axis between the arm 31 and the connecting rod 41 is indicated with 41A and may be arranged in an intermediate position between the hinge axis A25 and the hinge axis 31B. In some embodiments, the distance between the hinge axis 41A and the hinge axis 31B is smaller than the distance between the hinge axis 41A and the hinge axis A25.

Figure 5:
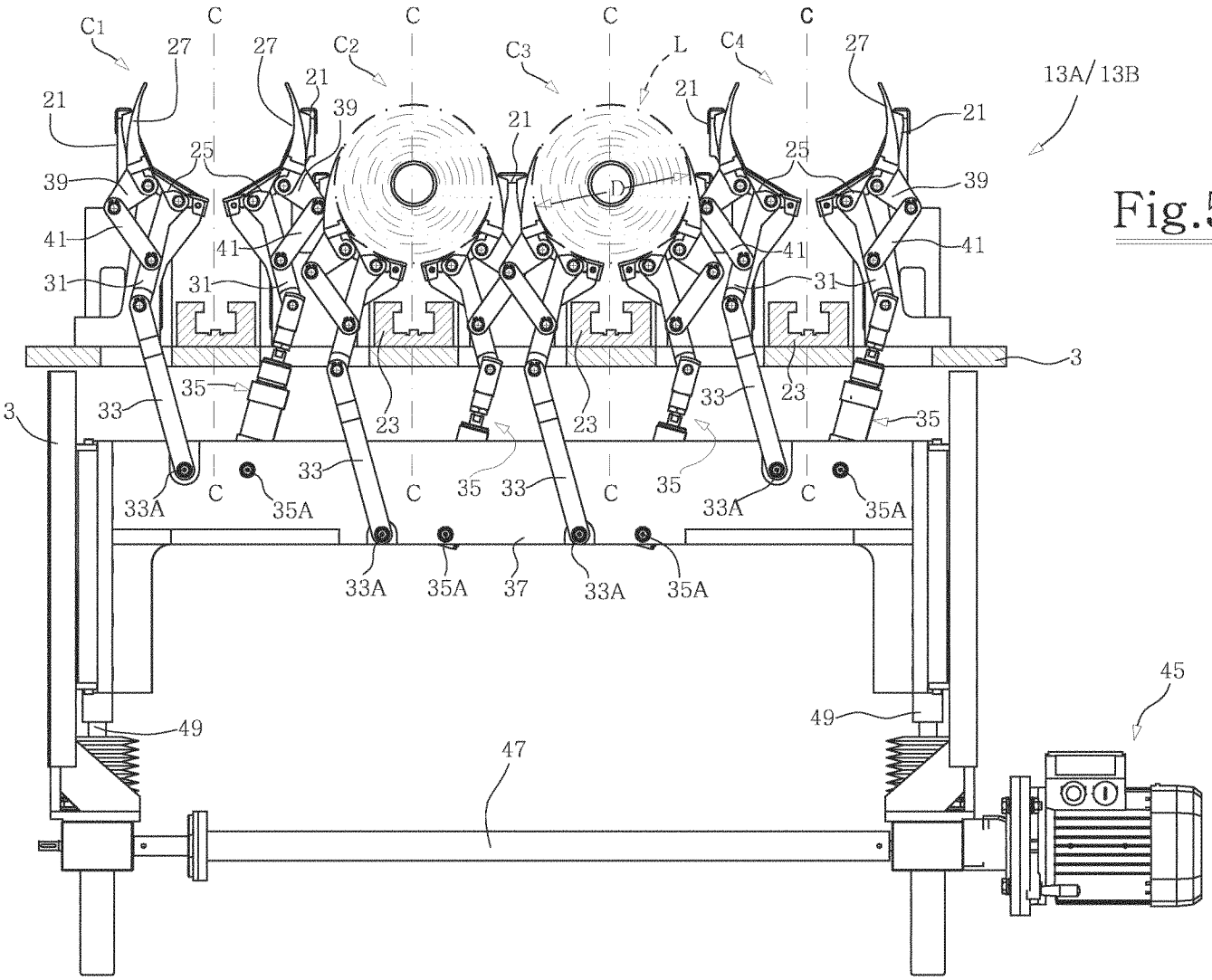
FIG. 5 is a front view of the clamp devices of the previous figures.
Figure 5A:
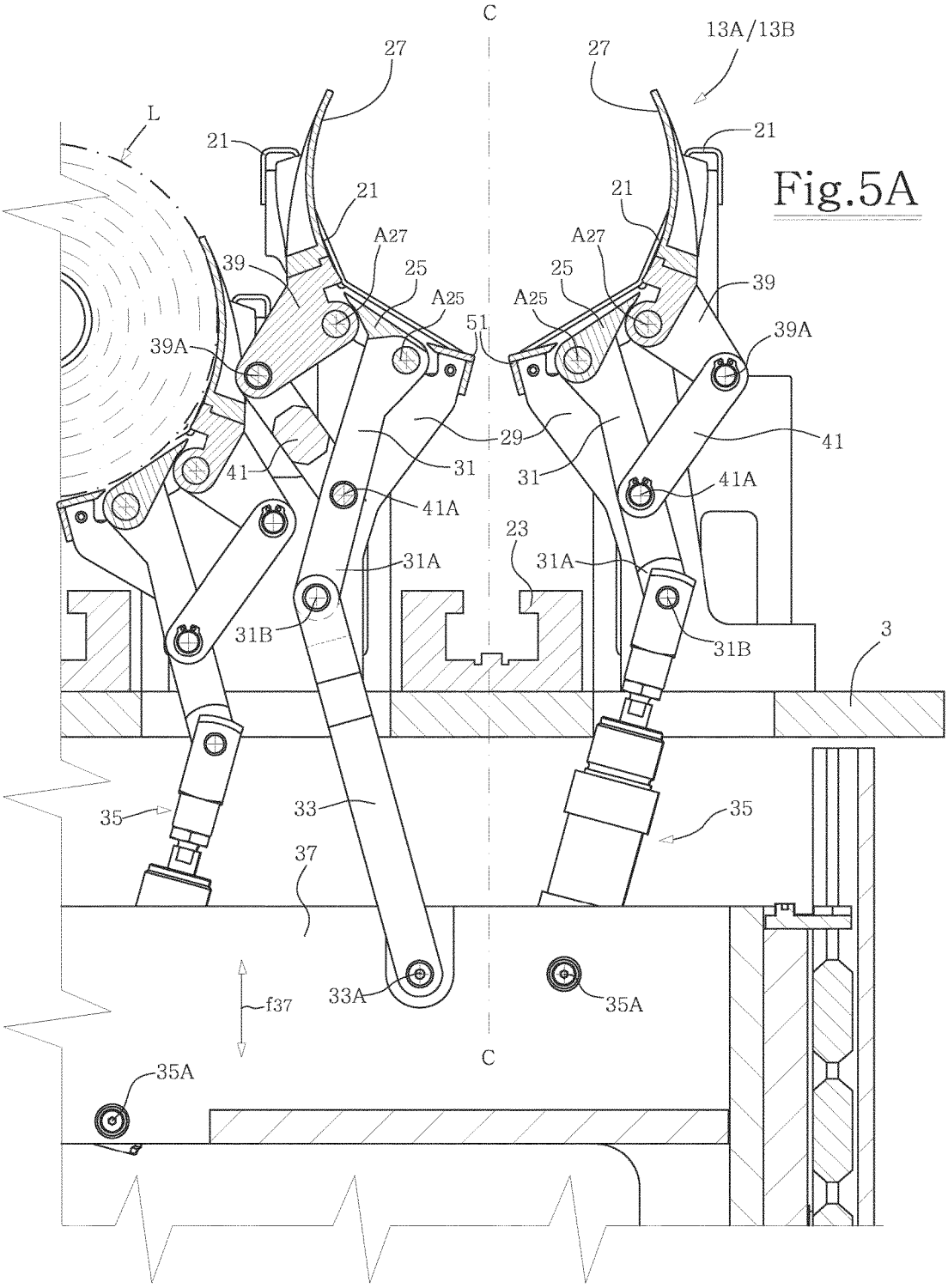
FIG. 5A shows an enlargement of one of the devices of FIG. 5.

As it is easily understood for example from FIG. 5A, each set comprising the small arm 39, the connecting rod 41, the arm 31, and the upright 29 defines a four-bar linkage. The side formed by the upright 29 between the hinge axes A25 and A27 is the fixed element of the four-bar linkage. The arm 31 and the small arm 39 define two rockers of the four-bar linkage, connected to each other by means of the connecting rod 41. The first jaw 25 and the second jaw 27 are respectively integral with each connecting rod 31, 39. The position of the jaws 25, 27 on each side of the symmetry plane C-C may be therefore controlled and modified through the movement of the respective four-bar linkage 29, 31, 39, 41. The movement of each four-bar linkage is controlled by means of the respective rod-strut 33, 35. The rods-struts 33, 35 may move by lifting and lowering of the cursor 37 according to the double arrow f37. By moving the cursor 37 upwards or downwards, the position of the jaws 25, 27 of each device 13A, 13B changes.

FIGS. 3 and 4 show two alternative positions of the cursor 37. In FIG. 3, the cursor 37 is in the highest position with respect to the fixed structure 3. To this position of the cursor 37 corresponds a closed position of the jaws 25, 27. This position is taken when logs L of small diameter shall be processed.

In FIG. 4, the cursor 37 is in a position lower than that of FIG. 3. To the position of the cursor 37 illustrated in FIG. 4 corresponds a more opened position of the jaws 25, 27 of each device 13A, 13B. This position corresponds to a greater diameter of the logs L to be cut.

Therefore, by adjusting the position of the cursor 37 according to the double arrow f37, it is possible to adapt the reciprocal position of the jaws 25, 27 of each device 13A, 13B to the diameter of the logs L to be cut. In FIG. 3 and in FIG. 4 logs L with diameter d and D, respectively, are indicated by way of example with a broken line, corresponding to two different arrangements of the jaws of the retaining devices 13A, 13B.

By using a single cursor 37 for all the rods-struts 33, 35 associated with the pairs of devices 13A, 13B of all the channels C1-C4, it is possible to adapt the various devices 13A, 13B to the diameter of the logs L processed by the saw machine 1 with a single movement. This is particularly advantageous as it allows a fast adjustment of the devices 13A, 13B as the diameter of the logs L varies. It should be understood that, under normal operating conditions, the saw machine 1 cuts logs L of equal diameters in each of the four channels with which it is provided. When the diameter of the logs changes, this occurs for all the logs of the four channels.

However, it is possible to use different cursors for each channel C1-C4, for example when logs L with different diameter for each single channel C1-C4 shall be processed. In this case, it is necessary to adjust the position of the jaws of each channel C1-C4 independently of one another.

In some embodiments, the adjustment of the vertical position (arrow f37) of the cursor 37 may be made manually. In other embodiments, as illustrated in the attached drawings, an actuator may be provided, for instance an electric motor, a hydraulic motor, a servo-motor or other actuating device 45, in order to adjust the vertical position of the cursor 37. The actuator 45 may act on a rotating bar 47 extending transversally the saw machine 1, so as to act simultaneously on two bars 49 arranged at opposite ends of the cursor 37.

In order to allow a better control of the logs L to be cut, and to allow the advancing movement thereof without too much friction through the pairs of clamp devices 13A, 13B, the rod-strut 35 of variable length may be used. By modifying the length of the rod-strut 35 it is possible to open and close, with a small movement of the respective four-bar linkage, a pair of jaws 25, 27, maintaining the cursor 37 in fixed position. By lengthening the rod-strut 35, the pair of jaws 25, 27 closes, whilst, slightly shortening the rod-strut 35, the pair of jaws 25, 27 associated therewith slightly opens, while the corresponding and symmetrical pair of jaws 25, 27 associated with the rod-strut 33 remains fixed. In this way it is possible to operate as follows. Each log L moves forward in an intermittent way along the respective channel C1-C4. Once a forward stroke has been performed, with the jaws 25, 27 slightly opened to reduce as much as possible the friction exerted by the same jaws 25, 27 on the log L, the rod-strut 35 is slightly elongated to clamp the log between the two pairs of jaws 25, 27. In this condition, wherein the log L is clamped, the cut is performed with a movement of the cutting blade 11 along the cutting plane T-T. Once the log has been cut, the rod-strut 35 may be slightly shortened again so as to release the log L and the cut roll R and to allow them to move forward easily along the advancing path defined by the respective channel C1-C4, up to bring the log L in the new position where the next cut shall be done.

The movement of the rods-struts 35 of the single adjacent channels C1-C4 may be not simultaneous for each channels, but rather offset, due to the fact that cutting of the logs L occurs in time sequence in the single channels C1-C4 due to the effect of the orbital movement of the cutting blade 11.

In some embodiments, to each channel C1-C4 also third stationary jaws 51 may be associated, arranged in the lower part of the log advancing path. The jaws 51 may be fixed with respect to the stationary structure 3 of the saw machine 1. For example, the jaws 51 may be integral with the uprights 29 associated with each channel C1-C4.

In modified embodiments, to have an opening and closing movement of the jaws that allows or facilitates the forward movement of the logs between a cut and the subsequent one, both the rods-struts 33, 35 may be constituted by, or may incorporate, an element, for instance a cylinder-piston actuator, allowing the length change.

However, this configuration would require a number of cylinder-piston actuators equal to twice the number of retaining devices of the machine, involving high costs and constructional difficulties.

Figure 6:
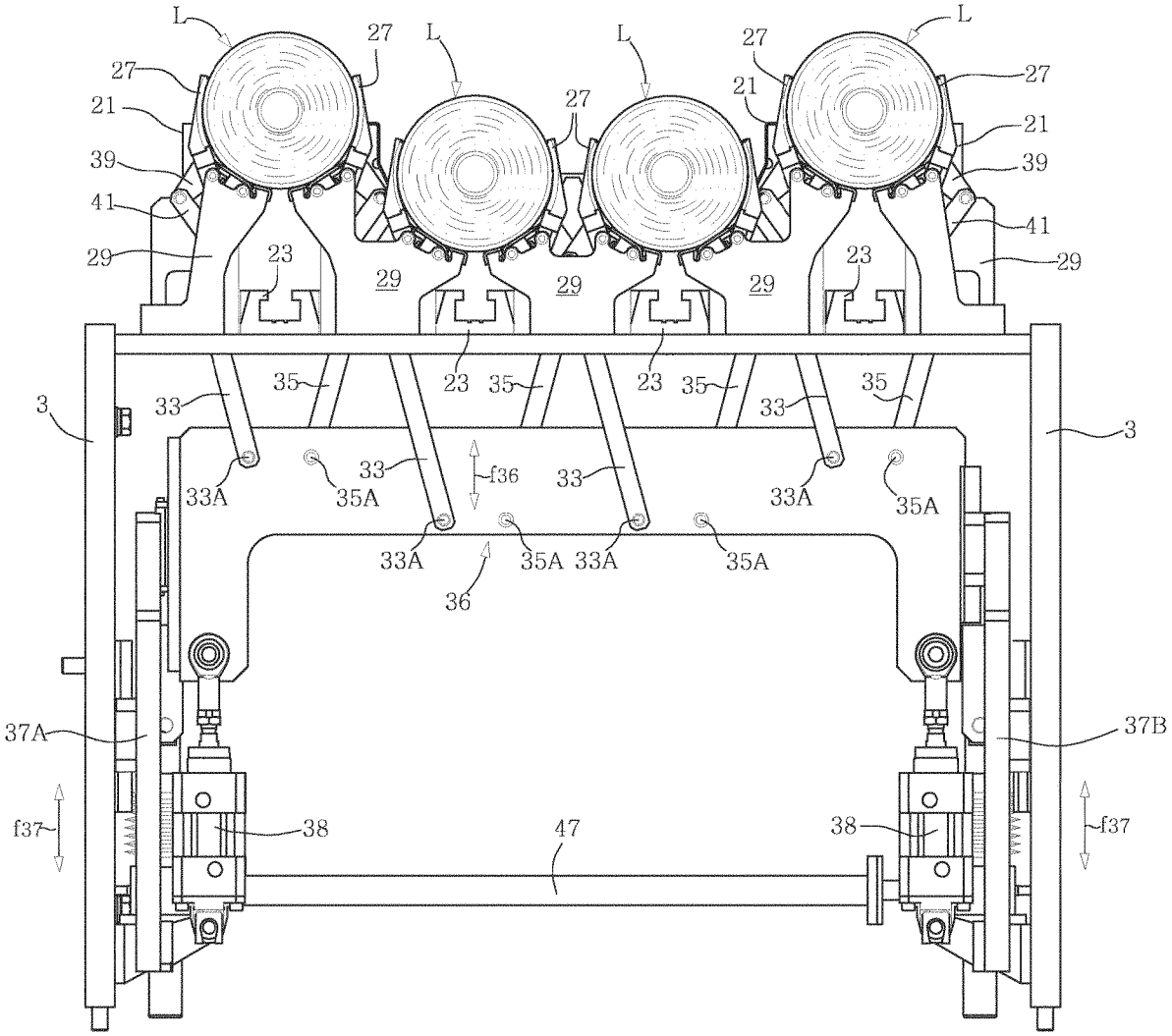
FIG. 6 shows a view, similar to FIGS. 4 and 5, of a further embodiment.

FIG. 6 illustrates a modified embodiment wherein, with a simpler structure, it is possible to achieve the same actuation symmetry. The same elements in the exemplary embodiment of FIG. 6 and of FIGS. 1-5 are indicated with the same reference numbers and are not described again. For further detail reference should be made to the description above. Here below those elements will be described that differentiate the embodiment of FIG. 6 with respect to the embodiment of FIGS. 1-5.

In FIG. 6, the rods-struts 35 are constituted, similarly to the rods-struts 33, by rigid members, for instance bars or connecting rods. To obtain the opening and closing movement of the jaws 25, 27 synchronously with the forward movement of the logs L, the ends of the rods-struts 33, 35 farthest from the jaws are hinged, in 33A and 35A, to a movable element constituted, in this embodiment, by a slide 36 vertically movable according to the double arrow f36. The movement f36 of the slide 36 is controlled by a servo-mechanism comprising, for example, one or two linear actuators. In the illustrated example, the movement of the slide 36 is imparted by two cylinder-piston actuators 38, for instance of the pneumatic type.

The actuators 38 and the slide 36 are, in turn, carried by a pair of side cursors 37A, 37B functioning as a cursor or movable member 37, as it will be clearly apparent from the description below. The reference number 47 indicates a shaft for moving the two cursors 37A, 37B together vertically, according to the double arrow f37. In other embodiments, the cursors 37A, 37B may be rigidly connected to one another, so as to form a single cursor 37, as illustrated in the previous figures.

In FIG. 6, the electric motor, or other servo-mechanism controlling the movement f37 of the movable member constituted by the cursors 37A, 37B, has been omitted.

The movement f37 is independent of the movement f36. The first movement f37 serves to adjust the reciprocal position of the jaws 25, 27 according to the diameter of the logs L to be cut. The second movement f36 is a fast movement with limited stroke, for opening and closing the jaws against the log L synchronously with the forward movement of the logs.

Therefore, the solution illustrated in FIG. 6 allows reducing the number of cylinder-piston actuators needed to control opening and closing of the jaws, with respect to what described in FIGS. 1-5. Moreover, it allows a symmetrical opening and closing movement of the jaws, whilst in FIGS. 1-5 the movement is given only to the right (in the figures) jaws and not to the left jaws, with a consequent asymmetry. The solution of FIG. 6 allows a better operation of the device and of the saw machine.

In the embodiments described above and illustrated in FIGS. 1-6, the movement for adjusting the position of the jaws 25, 27 according to the diameter of the log L is provided by means of a movable member 37 in the form of a cursor, or members 37A,37B in the form of double cursor, provided with a translation movement. However, this is not strictly necessary. The adjusting movement, in fact, may be obtained for instance with a rotating or oscillating mechanism.

Figure 7:
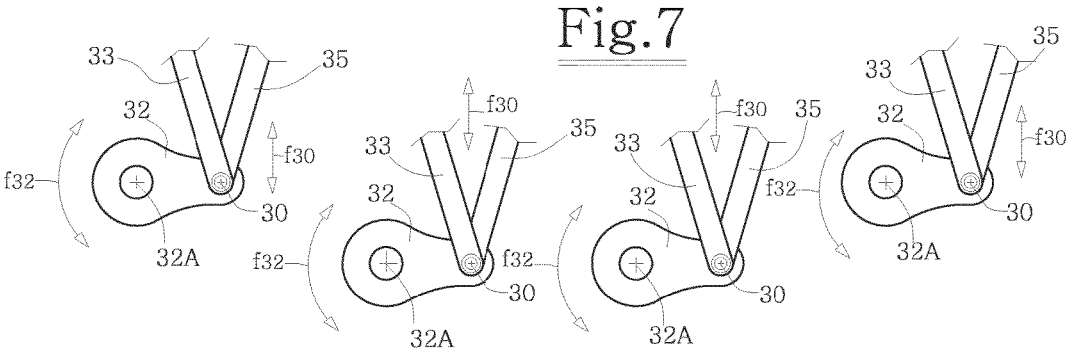
FIGS. 7 and 8 show a diagram of a further embodiment of an adjusting mechanism to adjust the position of the jaws.
Figure 8:
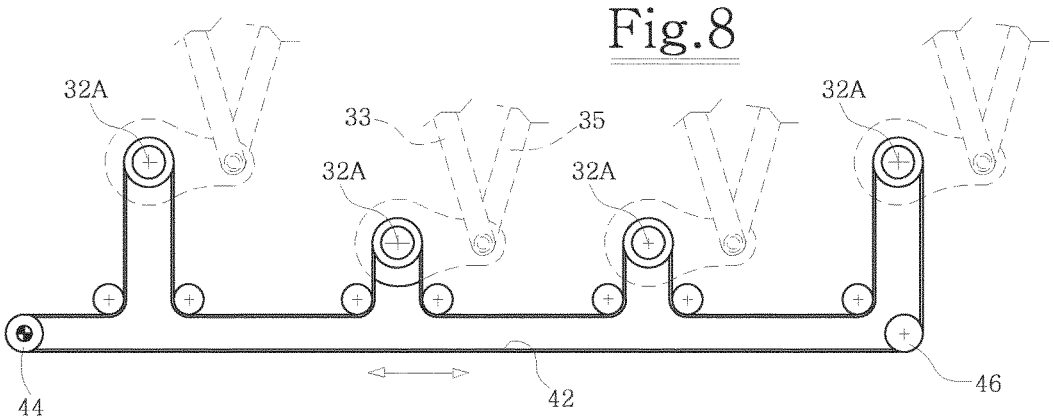

Two pairs of rods-struts 33, 35 are shown in FIG. 7, associated with two adjacent devices 13A, 13B, whose other components have been omitted for the sake of simplicity of the drawing, being understood that they may be configured as described with reference to FIGS. 1-6. The two rods-struts 33, 35 may have a fixed length, or a variable length, or it is also possible that one of them has a fixed length and the other has a variable length (as shown in FIGS. 1-5). They are hinged, in a common point 30, to an oscillating arm 32 rotating around a shaft 32A. The oscillation or alternating rotation according to f32 of each oscillating arm 32 may be controlled in any suitable manner. For example, electric motors may be provided (in-line motors or motors provided with bevel gear transmission) to control the rotation of the shafts 32A. The rotation is preferably synchronous and may be controlled electronically. FIG. 8 shows a kinematic arrangement with which (through an endless belt 42 driven around pulleys 44, 46) a simultaneous rotation by equal angles of the shafts 32A, and therefore of the arms 32 is obtained. To this end, one of the pulleys 44, 46 is motorized. The movement of the preferably toothed belt 42 causes the simultaneous and identical rotation of all the shafts 32A and, thus, an adjustment of the position of the hinge 30 according to the direction f30. This consequently causes an adjustment of the position of the jaws 27, 25.

In some embodiments, the rods-struts 33, 35 may be rigid and may have fixed length, and the opening and closing movement of the jaws synchronized with the forward movement of the logs L may be omitted, or it may be provided by means of the same mechanism of FIG. 8. Alternatively, as mentioned above, one or the other or both the rods-struts 33, 35 may be constituted by, or may comprise, a linear actuator such as a cylinder-piston like in FIGS. 1-5.

Figure 9:
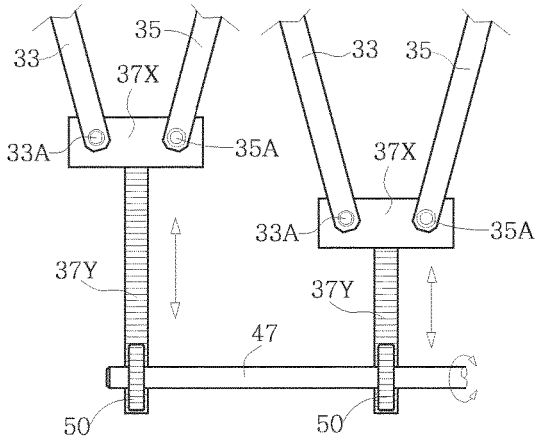
FIGS. 9 and 10 show diagrams of two further embodiments of the adjusting mechanism to adjust the position of the jaws.

FIG. 9 shows a different embodiment of the adjusting mechanism to adjust the position of the jaws 25, 27. In this case again, the rods-struts 33, 35 are partially indicated, while the other components of the device 13A, 13B have been omitted for the sake of simplicity of representation. The two rods-struts 33, 35 may be hinged, in 33A, 35A, to a single cursor 37X. This may be rigidly connected to a rack 37Y engaging a pinion 50 hinged on the shaft 47. The rotation of the shaft 47 causes the movement of the cursor 37X according to the arrow f37. This movement may be used to adjust, in the way described above, the position of the rods-struts 33, 35 and, thus, of the jaws 25, 27. The same movement may be used to open and close the jaws synchronously with the forward movement of the logs. Alternatively, it is possible to provide one or the other or both the rods-struts 33, 35 with a respective cylinder-piston actuator to obtain, as in FIGS. 1-5, the function of changing the length of the rod-strut and therefore the function of opening and closing the jaws 25, 27.

Figure 10:
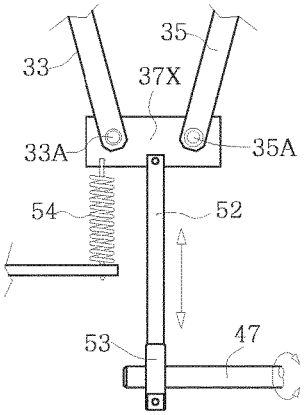

A further embodiment of the mechanism for moving the jaws 25, 27 for adjustment and/or for opening and closing is schematically illustrated in FIG. 10. In this exemplary embodiment, the cursor 37X is fastened to a belt 52 or other flexible member, whose second end is wound around a pulley 53 keyed on the shaft 47. A resilient member 54, for instance a compression spring, pushes the cursor 3X upwards. The downward movement is controlled by winding the belt 52 around the pulley 53.

The above description is a detailed description of a specific embodiment, given just by way of example. It should be understood that many of the details described above may be modified, without however departing from the scope of the invention, which is defined by the attached claims.

For example, in the embodiments described above the two rods-struts 33, or 33, 35 of each pair of sets of jaws 25, 27 are fastened, at the respective second ends, to a common movable member. In the embodiment of FIGS. 1-5 the rods are hinged, in 33A and 35A, to the common movable member 37. In the embodiment of FIG. 6, the rods-struts 33, 35 are hinged, in 33A, 35A, to the element 36 forming part of a common movable member 37A, 37B. However, as mentioned with reference to FIGS. 1-5A, the rods 33, 35 may be fastened to separate movable members, each of which may be associated with a respective actuator. The two movable members associated with the rods-struts 33, 35 of a pair of sets of jaws associated with a same advancing channel for the logs to be cut may be advantageously actuated in a symmetrical and synchronous manner, even if this is not strictly necessary for the adjustment, that can be offset for the two sets of jaws arranged on the two sides of the longitudinal symmetry plane C-C.

In other embodiments, the movement of the rods-struts may be obtained by providing these latter so that they can be lengthened and shortened. For example, in some embodiments both the rods-struts 33, 35 of each pair of set of jaws may be constituted by, or may comprise, linear actuators, such as cylinder-piston actuators. In FIGS. 1-5A this approach has been already adopted for the rod-strut 35. It is also possible for the other rod-strut 33 to be made in form of a linear actuator. The two linear actuators, or other structure with extendable or retractable length constituting the respective rods-struts 33, 35 may be hinged (on axes 33A, 35A) to a fixed element, for instance a beam of the stationary bearing structure 3.

In this case, both the adjusting movement to adjust the position of the jaws by means of the four-bar linkages, and the opening and closing movement of the jaws to facilitate the forward movement of the logs to be cut, are controlled by one, by the other or by both the actuators forming part of the rods-struts 33, 35.

In other embodiments, the second ends of the extendable and retractable rods-struts 33, 35 may be hinged in 33A, 35A to a movable member such as the movable member 37. In this case it is possible, for example, to use the movement of the movable member 37 to adjust simultaneously the position of the two sets of jaws through the oscillation of the respective four-bar linkages, controlled by the movement of the movable member 37 through the rods-struts 33, 35. The movement of one or both the linear actuators constituting part of the rods-struts 33, 35 may be used to open and close the jaws synchronously with the forward movement of the logs to be cut, in order to facilitate the feeding thereof.

Even though using linear actuators, such as cylinder-piston actuators, it is possible to lengthen and shorten the rods-struts 33, 35 in a servo-controlled manner, it is also possible to use rods-struts that can be lengthened and shortened in a different way, for instance without a servo-actuator. In some embodiments, one or both the rods-struts may be provided as elements that can be lengthened and shortened manually, for instance with a screw system. In this case, the opening and closing movement of the jaws synchronously with the forward movement of the logs to be cut, may be provided, if necessary, through the servo-controlled movement of the movable member 37 or other equivalent member, to which the rods-struts may be fastened.

In other embodiments, it is possible to provide a rod-strut with servo-controlled lengthening and shortening, for instance providing it in the form of a linear actuator such as a cylinder-piston, and to provide the other rod-strut with a manual adjustment of the length. In this case the two rods-struts may be hinged to fixed axes and may be adjusted manually and with the actuator to adapt the device to the diameter of the logs, while the opening and closing movement of the jaws to facilitate the forward movement of the logs to be cut may be provided by acting on a single set of jaws, i.e. on the set where the rod-strut is formed by the linear actuator.

The invention claimed is:

1. A device to clamp a log (L) to be cut, comprising a log advancing path and, on each side of an intermediate plane (C-C) parallel to the advancing path, a set of jaws, each set comprising a first jaw (25) and a second jaw (27), the first jaw (25) being hinged to a fixed structure (29) around a first pivoting axis (A25) and the second jaw (27) being hinged to the fixed structure (29) around a second pivoting axis (A27); wherein each first jaw (25) and second jaw (27) are joined together by means of a connecting rod (41) and form, with said connecting rod (41) and the fixed structure (29), a four-bar linkage, the first jaw (25) and the second jaw (27) forming a respective first rocker and a respective second rocker of the four-bar linkage; wherein the first rocker is hinged to a first end of a respective rod-strut (33, 35); and wherein the rod-strut (33; 35) is movable in order to make the respective four-bar linkage oscillate and to cause the adjustment of the jaws position according to the diameter of the log to be cut.

2. Device according to claim 1, wherein the first rocker extends, thus forming an arm (31), through which the first rocker is hinged to the rod-strut.

3. Device according to claim 1, wherein the rod-strut is hinged, at a respective second end, to a movable member (32; 37; 37A, 37B), the motion of the movable member (32; 37; 37A, 37B) causing oscillation of the respective four-bar linkage.

4. Device according to claim 3, wherein the movable member (37; 37A; 37B) moves according to a direction substantially orthogonal to the advancing path of the logs (L).

5. Device according to claim 1, wherein each respective rod-strut (33; 35) are hinged, at a respective second end, to a common movable member (32; 37; 37A, 37B), having a movement that causes symmetrical oscillation of each respective four-bar linkage.

6. Device according to claim 1, further comprising an actuating mechanism to control an opening and closing movement of the first jaw (25) and of the second jaw (27), synchronously with forward movement of the log on the log advancing path.

7. Device according to claim 6, wherein the actuating mechanism comprises a lengthening and shortening mechanism for at least one respective rod-strut (33, 35).

8. Device according to claim 7, wherein the lengthening and shortening mechanism comprises a cylinder-piston actuator.

9. Device according to claim 6, wherein the actuating mechanism comprises a movable element (36), to which at least one respective rod-strut is hinged.

10. Device according to claim 1, wherein at least one respective rod-strut (33; 35) has variable length.

11. Device according to claim 1, wherein each respective rod-strut (33, 35) is fastened to a movable element (32; 36; 37X) associated with an actuating member to control an opening and closing movement of the first jaw (25) and of the second jaw (27), synchronously with the forward movement of the log.

12. Device according to claim 1, wherein each connecting rod (41) is hinged to the respective arm (31) in a position intermediate between the first pivoting axis (A25), around which the first jaw (25) is hinged to the fixed structure (29), and a pivoting axis (31B), around which the arm (31) is hinged to the respective rod-strut (33, 35).

13. Device according to claim 12, wherein each second jaw (27) is provided with a small arm (39), to which the respective connecting rod (41) is hinged.

14. Device according to claim 1, each first jaw (25) and second jaw (27) of the set of jaws further comprises a third jaw (51), stationary with respect to the fixed structure (29).

15. Device according to claim 14, wherein each first jaw (25) is arranged between the third jaw (51) and the second jaw (27), the respective third jaw (51) of each set of jaws being adjacent to each other in a position below the log advancing path.

16. Device according to claim 1, wherein each second jaw comprises an elongation symmetrically extending above a respective first jaw and around the advancing path.

17. A saw machine (1) comprising the device of claim 1 to clamp a log, said saw machine for cutting said log (L) comprising a log of wound web material, said saw machine further comprising: a cutting blade (11) configured and controlled to cut the log according to a cutting plane (T-T) orthogonal to the advancing path for the log (L), said saw machine further comprising log feeding members (7), having movements synchronized with movement of the cutting blade (11) to advance the log on the advancing path; and, along said advancing path, said device to clamp the log (L) arranged adjacent to the cutting plane (T-T) of the cutting blade (11).

18. Saw machine according to claim 17, comprising, for said log advancing path, a second device to clamp the log, wherein the first device and the second device the log (L) are arranged on opposite sides of the cutting plane (T-T).

* * * * *